United States Patent [19]

Kuhn

[11] Patent Number: 5,001,790

[45] Date of Patent: Mar. 26, 1991

[54] BED WITH DISPOSABLE BEDPAN

[75] Inventor: George C. Kuhn, East Rochester, N.Y.

[73] Assignee: Try Sheet, Inc., East Rochester, N.Y.

[21] Appl. No.: 345,637

[22] Filed: Apr. 28, 1989

Related U.S. Application Data

[63] Continuation-in-part of Ser. No. 90,970, Aug. 31, 1987, Pat. No. 4,833,742, Continuation-in-part of Ser. No. 935,016, Nov. 28, 1986, Pat. No. 4,689,842.

[51] Int. Cl.[5] ..... A61G 7/02

[52] U.S. Cl. ..... 5/90; 5/463

[58] Field of Search ..... 4/451, 452, 456, 144.2; 5/50, 463

[56] References Cited

U.S. PATENT DOCUMENTS

| | | | |
|---|---|---|---|
| 2,318,240 | 5/1943 | Mas | 5/90 |
| 2,932,831 | 4/1960 | Keathley, Sr. et al. | 5/90 X |
| 4,011,610 | 3/1977 | Parker, III | 5/90 |
| 4,282,613 | 8/1981 | Violante | 5/90 |
| 4,689,842 | 9/1987 | Kuhn | 5/90 X |
| 4,833,742 | 5/1989 | Kuhn | 5/90 |

FOREIGN PATENT DOCUMENTS

| | | | |
|---|---|---|---|
| 374328 | 6/1932 | United Kingdom | 5/90 |

*Primary Examiner*—Michael F. Trettel
*Attorney, Agent, or Firm*—Robert M. Phipps

[57] ABSTRACT

A bed for assisting bedridden patients in the excretory functions. The bed includes a frame, a patient platform disposed on the frame. The patient platform includes a passageway for allowing passage of excrement from the patient. A mattress is provided on top of patient platform which includes an excretal mattress section for placement over the opening and allowing passage of excrement through the opening. A bed pan assembly is provided for use with the bed which includes a support frame. The frame is provided with supports for holding a disposable container. The bed pan assembly further includes at least one cushion support layer for providing support to the patient.

18 Claims, 7 Drawing Sheets

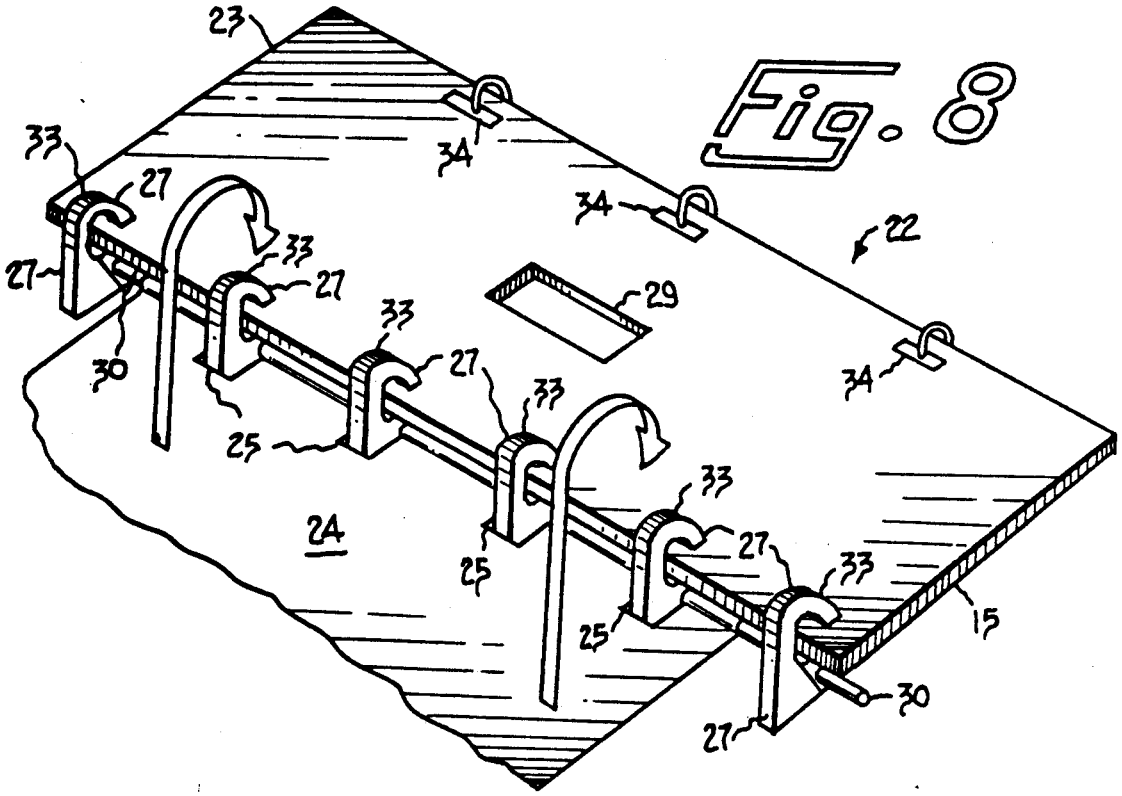
Fig. 8
Fig. 6
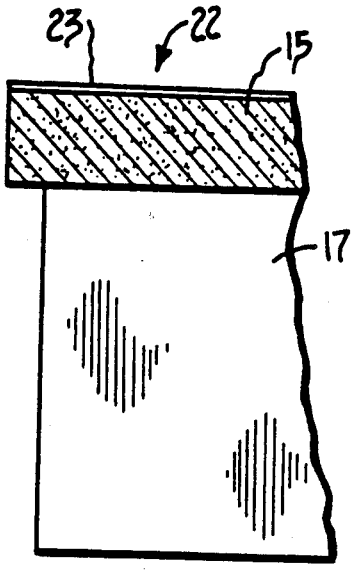
Fig. 7
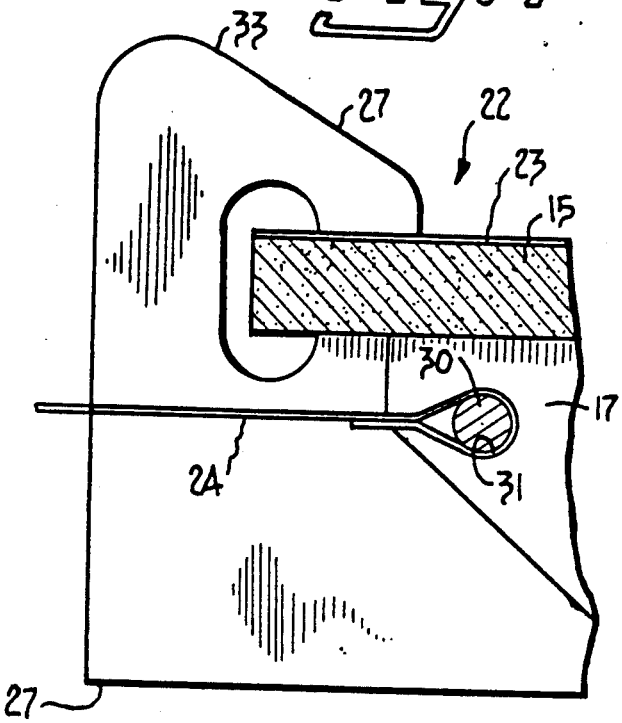

BED WITH DISPOSABLE BEDPAN

RELATED APPLICATIONS

This application is a continuation-in-part of application Ser. No. 090,970, filed Aug. 31, 1987 now U.S. Pat. No. 4,833,742, which is a continuation-in-part of application Ser. No. 935,016, filed Nov. 28, 1986, now U.S. Pat. No. 4,689,842.

BACKGROUND

1. Field of the Invention

This invention relates to the caring for the excretory functions of the bedridden patients.

2. Description of the Prior Art

The care of a bedridden patient over the years has been unsatisfactory with respect to on going body functions such as the excretory organs. It has reached the point that jokes and sad stories about patients' use of bedpans are legion. In U.S. Pat. No. 266,167 (1882) A. Leslie disclosed an invalid hammock which was fastened at the foot of the bed, passed over the very high head board and down the back side of the head board to a crank operated drum. By this means slack in the hammock could be reduced, thus suspending the patient or slack let out to lower the patient. The patient could be lowered down on to the bed's mattress. To enable the patient to use the bed pan without leaving the hammock, an opening, where the buttocks usually come, was provided. The opening could be covered with a flap. As is commonly known, this concept was not adopted as practical.

J. A. Devore, et al in the U.S. Pat. No. 778,570 (1904) disclosed an invalid bed in which a stretcher was installed on a telescoping frame. The stretcher could be raised from the mattress, by a crank mechanism at the foot of the bed, a sufficient distance from the mattress to insert a vessel, i.e., bed pan and the like, under the hole in the stretcher. It was intended that the patient be continuously on the stretcher. Preferably, the stretcher was made of waterproof material. Again, this device as not adopted by the public as a practical means of caring for the bedridden patient. One can readily imagine the bedridden patient's comfort on such a device.

F. T. Ridley, in U.S. Pat. No. 1,981,666 (1934) dislosed an inflatable device for use as a bed lift and to support patients in conjunction with, among other things, use of bed pans. The device anchored at the head and foot of the bed, is continuously maintained beneath the patient. Because of its waterproof construction, the long term patient's discomfort will be readily apparent.

G. C. Kuhn in U.S. Pat. No. 4,689,842 granted upon application Ser. No. 935,016 filed Nov. 26, 1986 discloses aiding bedridden persons in the use of bed pans and the like by placing the person on a full length platform device with an opening so located that the excreted waste falls directly into the bed pan below the platform. The patient can be moved on to the platform device by the use of a lifting sheet which is attached along one side of the patient motivation device. The platform device is supported above the patient's bed by a series of rigid and resilient supports which work in combination to assist in the placement of the person on the platform device. The bed pans used in this invention can be any of the previously known pans, all of which are characterized by a rigid construction and substantially open top. This construction presents problems in the handling of wastes as well as the cleaning and storing of bed pans.

While the Kuhn bed platform has greatly eased the patient in carrying out their bodily functions there remains a great need for a convenient and aesthetic manner of handling the collected wastes. It is an object of this invention to provide a device for the collection of bodily wastes which eliminates the need to wash bed pans. It is a further object of this invention to provide a system for sanitary and aesthetically acceptable transportation of such wastes. Yet another object is to provide a patient platform which utilizes the waste collector of this invention while avoiding the need to transfer patients for this purpose. Still other objects will be apparent to those skilled in the art upon reference to the following detailed description.

SUMMARY OF THE INVENTION

In accordance with the present invention, there is provided a bed for assisting bedridden patients in their excretory functions comprising:

a frame having a substantially solid platform base;

a patient platform disposed on the platform base for supporting a patient, the patient platform comprising a patient carrier support surface which is supported by a plurality of stiff carrier supports, the patient carrier support having an opening therein so as to provide a communication passage for allowing passage of excrement from said patient;

mattress means disposed on top of the patient platform for supporting the patient, the mattress means includes an excretal mattress section for placement over the opening for allowing passage of excrement through the opening.

In accordance with another aspect of the present invention, there is provided a bed pan assembly for use with a bed comprising:

(a) a support frame having means therein for engaging and supporting therefrom a disposable container;

(b) a disposable flexible container having means for mating with the support frame engaging means and receiving excrement from a patient in the bed; and (c) at least one cushion support layer for providing support to the patient in the bed.

DESCRIPTION OF THE DRAWINGS

FIG. 6 is an enlarged partial end view of the patient platform as shown in FIG. 5;

FIG. 7 is an enlarged partial end view of a patient motivating device equipped with a patient lifting sheet; and FIG. 8 is a perspective view of a patient motivating device with lifting sheet and having the supports shown in FIG. 7.

DESCRIPTION OF THE PREFERRED EMBODIMENT

Figure 5:
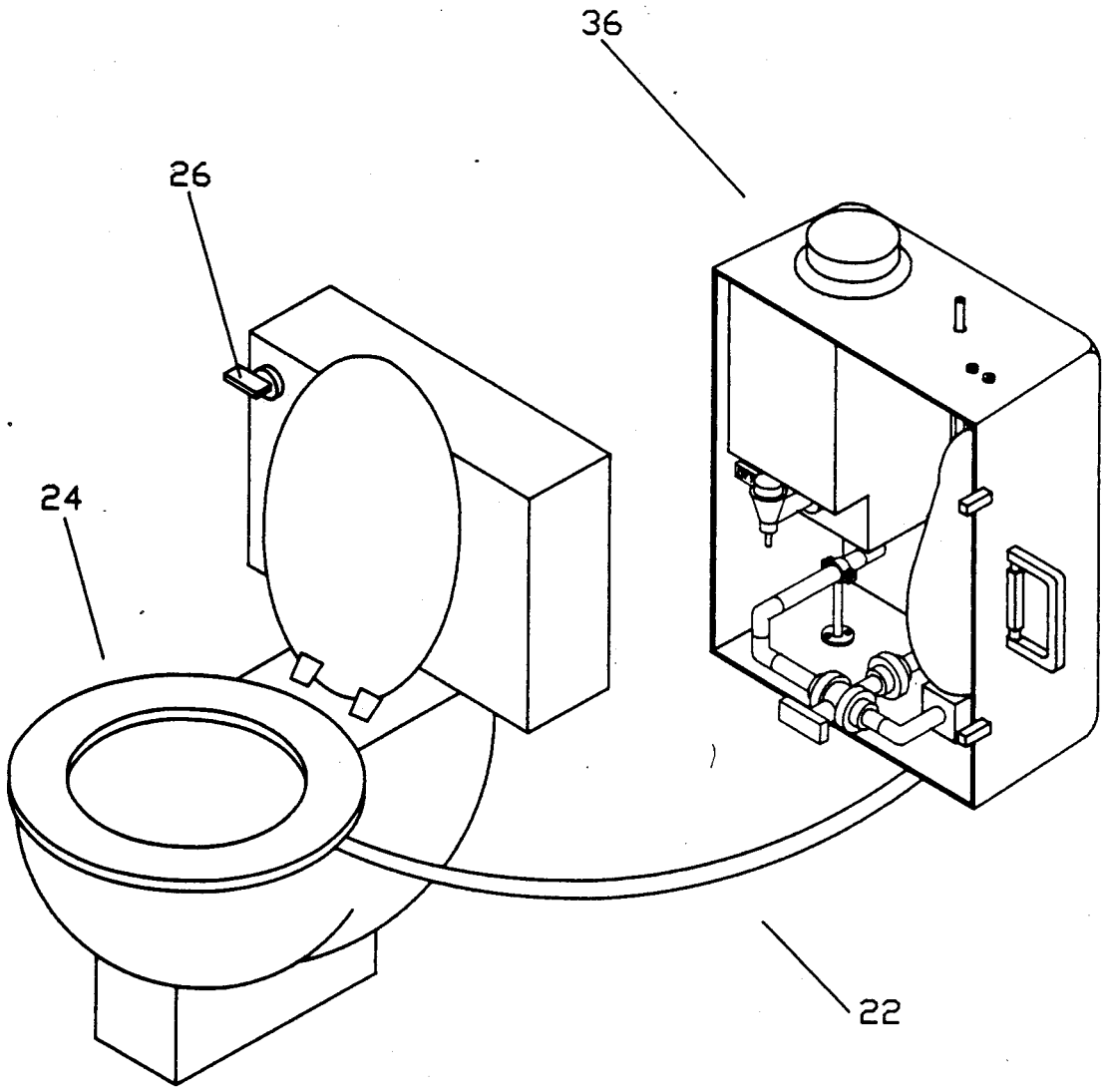
FIG. 5 is a perspective view showing the insertion of the disposable bed pan of FIG. 4 beneath a patient platform of this invention.
Figure 1:
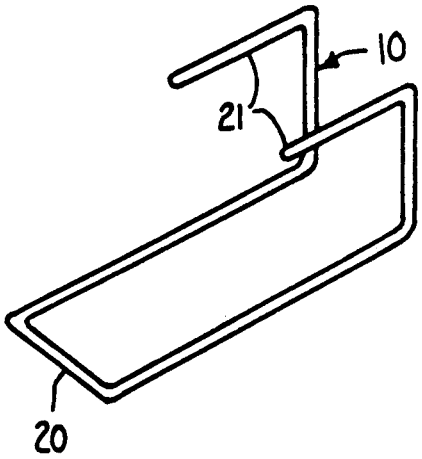
FIG. 1 is a perspective view of an open frame of this invention.
Figure 2:
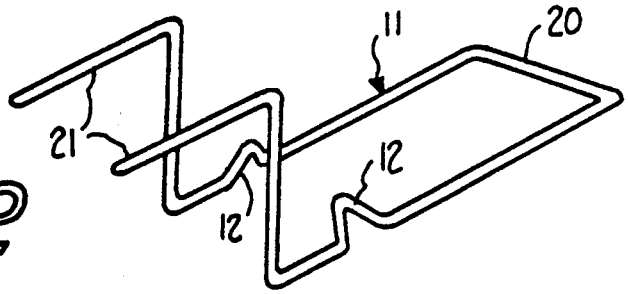
FIG. 2 is a perspective view of an alternate open frame of this invention.

Two variations of the structural frame member of the disposable bed pan of this invention are shown in FIGS. 1 and 2. In FIG. 1 the open frame 10 is designed to support, on support arm portion 21, a disposable container for a bed pan (not shown) underneath a patient and provide means, namely a handle section 20 on frame 10, for moving the bed pan into and out of position. In FIG. 2, the second variation of the frame, the support arm portion 21 of frame 11 has been reversed to extend underneath the patient and away from the handle section 20. The frame 11 has been further modified to include cushion retainers 12. The cushion retainers 12 comprises a pair of opposed wedge members which provide a wedging effect to hold a counter weight/patient platform support 16, as best seen in FIG. 5. Preferably retainers 12 are directed both upwardly and inwardly to enhance the wedging effect.

Figure 3:
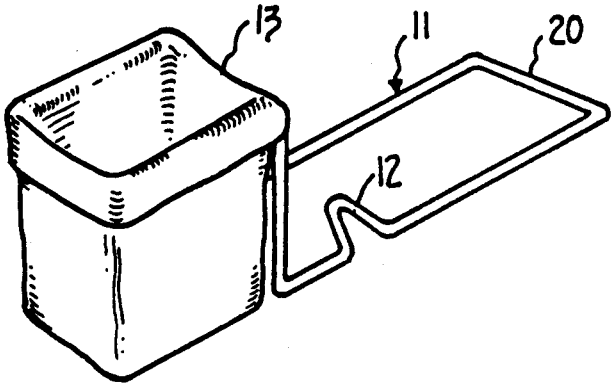
FIG. 3 is a top perspective view of the open frame of FIG. 2 with plastic liner.

FIG. 3 illustrates the placement of a plastic liner 13 on the liner support sections 21 of the frame 11. The liner 13 forms the excrement receiving cavity of the bed pan of this invention. The plastic liner 13 would be placed in a similar position on the open frame 10 variant of frames.

Figure 4:
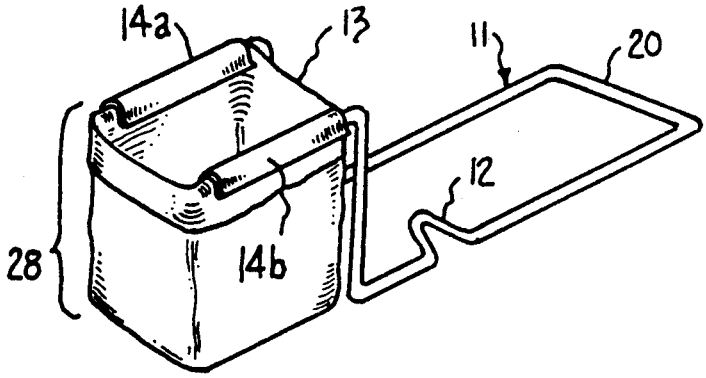
FIG. 4 is a top perspective view of the disposable bed pan of FIG. 3 with retaining clips installed.
Figure 5:
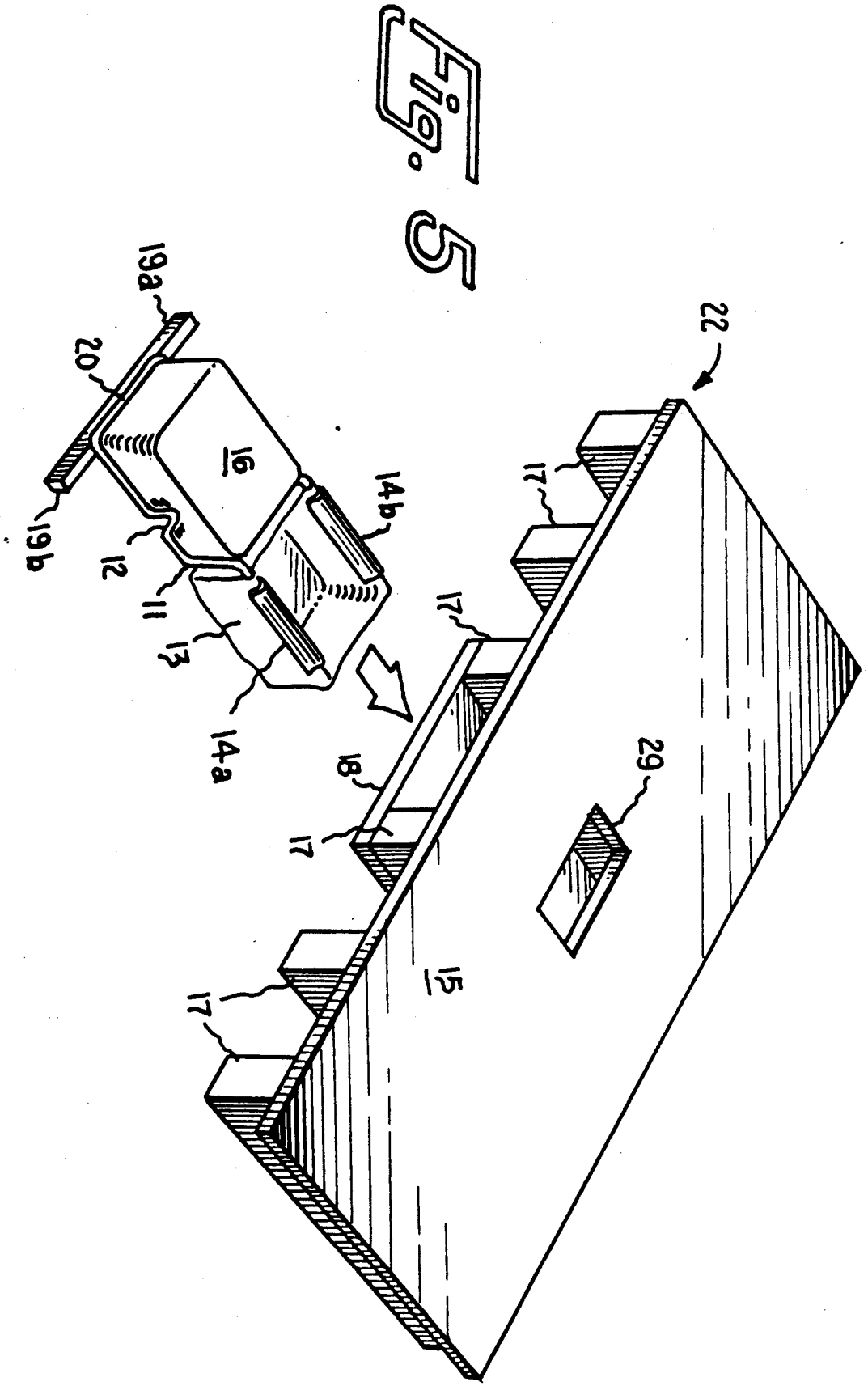

The plastic liner 13 may be secured in place on the frame 10 or 11 by the use of retainer clips 14, as shown in FIG. 4. The actual configuration of retainer clips 14 can be varied as desired. The highest degree of disposability of the plastic liner 13 is achieved by the use of retainer clips 14 made of a thin elastomeric plastic or a resilient plastic so that after use of the bed pan, the clips 14 are dropped into the plastic liner 13 along with the wastes. Additionally, plastic liner 13 may be modified to provide at the top of the liner 13 and along both of the sides of the liner 13 which are parallel to the support arm portion 21 loops which may be slipped on to the support arm sections 21.

The plastic liner 13 is preferably made of a thin plastic film such as polyethylene or other olefin material. The liner 13 can, for convenience, be formed into a number of useful shapes, e.g., a bag, prior to installation on to the frame 10 or 11. When a clear or translucent plastic is used, measuring marks may be placed on the liner 13 for measuring the amount of patient excrement. For aesthetic reasons, a perfume or fragrance may be incorporated into the plastic liner 13. Similarly, a germicide or bactericide may be incorporated into the liner 13 to enhance sanitation. Additionally, the liner 13 may be color coded to identify the wastes from various classes of patients. The particular fragrance, germicide or combination of agents and the like to be used is a matter of choice beyond the scope of this invention, but are well known to those skilled in those branches of the arts.

FIG. 5 illustrates the use of the disposable bed pan of this invention in conjunction with a patient platform 22. The patient platform 22 is disclosed in U.S. Pat. No. 4,689,842 as the patient motivation device 25 of FIG. 8 where the resilient supports 27 and the patient lifting sheet 24 function have been removed. Briefly, the platform 22 has a resilient patient support member 15 of size sufficient to fully support a reclining patient. The support member 15 is supported above the bed or similar surface by a plurality of stiff platform supports 17. A communicating opening 29 is formed in member 15 approximately beneath the excretory organs of a patient. This opening communicates with a bed pan, e.g. bed pan 28. Between and underneath the stiff platform supports 17 nearest the opening is a surface protector 18.

The patient platform, or patient motivating device, 25 as shown in FIG. 8 is made up of a patient carrier 15 supported by a series of stiff (that is substantially rigid vertical) carrier supports 17. In use, the patient rests on the upper side of the patient carrier 15 and is so positioned that the patient's excretory opening (anus and urinary) are suspended over the opening 29. The opening 29 forms a communicating passageway between the patient and collector, i.e. bed pan 28. In use, bed pan 28 is positioned under the patient support 15 and between stiff supports 17. Optionally, a surface protector 18 may be installed between supports 17 under the patient support 15 so that the surface on which the patient platform 22 or 25 rests will not be soiled.

In FIG. 8 the communicating opening 29 in patient support 15 to bed pan 28 is shown. Along one side of the patient support 15 and at the end of each stiff support 17 is located a resilient elevating carrier support 27. The stiff supports 17 and resilient supports 27 may be combined into one support with two functions, one on each side, or these supports can be two separate pieces as shown in FIG. 7. The resilient carrier support 27 is so configured as to enhance its resiliency in permitting the patient platform 25 to be depressed to the surface, e.g. of the bed, and to provide anchoring or engagement means for the lifting sheet 24. The lifting sheet 24 functions both as a means of moving the patient 26 from the bed to the patient platform 25 and as a modesty shield for the patient while using the bed pan 28.

The lifting sheet 24 is maintained in place on the patient platform 25 by the attachment at the lower surface of patient carrier 15. This attachment can be of several forms as desired, e.g., tabs on sheet 24 snap fastened to carrier 15, or a zipper substituted for the snaps, or loop tabs on sheet 24 which slide over a rod 21 (or pipe) retained in rod aperture 22 of rigid support 17 as shown in FIG. 7. Appropriate openings 25 are provided in lifting sheet 24 so that it rotates over and around the upper portion 33 of resilient support 27 when the sheet 24 is being used to move the patient on to the platform 25. The lifting sheet 24 when used as a modesty cover, is maintained in position over the patient 26 by use of clips 34 or snaps or interlocking fabric closures.

The relationship of stiff supports 17 and resilient supports 27 is more particularly shown by the end view of the patient platform 25 in FIG. 7. As shown, the end of stiff support 17 slopes away from the edge of and underneath patient platform 15. The end of resilient support 27 has a reverse, but complementing slope, with respect to stiff support 17, so that there is a continuous support under carrier 15. Stiff support 17 is permanently affixed to carrier 15 whereas resilient support 27 when not an integral part of rigid support 17 may be removably affixed.

In use, when the patient desires to use the bed pan 28, the attendant brings the patient platform 25 to the patient's 26 bed or guerney etc., and positions it along side of and behind the patient. Then the lifting sheet 24, attached to the platform 25, is passed under the patient. The free edge of the lifting sheet 24 is then pulled over to and across the platform 25. As the lifting sheet 24 is pulled, the patient is rolled over to and on to the carrier 15 without lifting by the attendant and positioned over opening 29. The patient is then ready to use the bed pan 28.

As the patient is rolled on to the carrier 15, the force exerted by the patient on the anchored side of the lifting sheet causes the resilient supports 27 to compress and deflect or tilt the carrier 15. When fully deflected, the edge of carrier 15 is substantially at the surface level of the bed, etc. As the patient continues to roll on to the carrier 15, their weight is shifted over a rod 21 (or pipe) retained in rod aperture 22 of rigid support 17 as shown in FIG. 7. Appropriate openings 25 are provided in lifting sheet 24 so that it rotates over and around the upper portion of resilient support 27 when the sheet 24 is being used to move the patient on to the platform 25. The lifting sheet 24 when used as a modesty cover is maintained in position over the patient 26 by use of clips 34 or snaps or interlocking fabric closures.

The relationship of stiff supports 17 and resilient supports 27 is more particularly shown by the end view of the patient platforms 25 in FIG. 7. As shown, the end of stiff support 17 slopes away from the edge of and underneath patient platform 15. The end of resilient support 27 has a reverse, but complementing slope, with respect to stiff support 17, so that there is a continuous support under carrier 15. Stiff support 17 is permanently affixed to carrier 15 whereas resilient support 27 when not an integral part of rigid support 17 may be removably affixed.

In use, when the patient desires to use the bed pan 18, the attendant brings the patient platform 25 to the patients 26 bed or guerney, etc. and positions it along side of and behind the patient. Then the lifting sheet 24, attached to the platform 25, is passed under the patient. The free edge of the lifting sheet 24 is then pulled over to and across the platform 25. As the lifting sheet 24 is pulled, the patient is rolled over to and on to the carrier 15 without lifting by the attendant and positioned over opening 29. The patient is then ready to use the bed pan 28.

As the patient is rolled on to the carrier 15, the force exerted by the patient on the anchored side of the liftin sheet causes the resilient supports 27 to compress and deflect or tilt the carrier 15. When fully deflected, the edge of carrier 15 is substantially at the surface level of the bed, etc. As the patient continues to roll on to the carrier 15, their weight is shifted over to the part supported by the stiff supports 17. This shifting over causes the carrier 15 to pivot or rotate back to its normal level position.

After the bed pan 28 has been used and removed the patient is returned to their original position by the reverse rolling motion. The attendant may reach over the carrier 15 and patient to grip the free edge of the lifting sheet 24 or may be assisted in gripping the lifting sheet 24 by the use of rods hooked into or straps (not shown) attached to the free edge of the lifting sheet 24.

Into the space defined by patient support 15, platform supports 17 and surface protector 18 is inserted a bed pan (comprised of frame 10, 11 beginning with the support arm portion 21, the plastic liner 13 and retainer clips 14 having been previously attached). As previously noted, cushion 16 provides a counterweight to the plastic liner 13 when containing excrement. Cushion 16 also provides further support for the patient support member 15. Finally, as illustrated, cushion 16 has been so configured that it has projections or stop tabs 19 extending sideways from it at the handle portion 20 of frame 11. When frame 11 is fully inserted stop tabs 19 will rest against the end of platform supports 17, thus automatically positioning the plastic liner 13 beneath the opening 29 in patient support member 15 and the patient's excretory organs.

After the plastic liner has been used it is sealed by any of a number of simple sealers such as a wire twist tie, a tape or a bar heat sealer now widely used to seal various flexible plastic containers. The sealed liner 13 is then disposed as desired.

As shown in FIG. 1, frame 10 does not require counter weighting to compensate for the excrement collected in the plastic liner 13. It is with the contemplation of this invention to provide stop tabs similar to stop tabs 19 on cushion 16 to the frame 10, 11 at the handle 20.

The frame 10, 11 can be made of metal or an engineering plastic such as polycarbonate as desired. The material of construction is a matter of choice to those familiar with this brand of the arts. The frame 10, 11 as a minimum size should fully support the plastic liner 13 containing the excrement while the maximum size when used in conjunction with a patient motivation device 22 would be that which will allow it to slide between the patient support member 15, sheet protector 18 and platform supports 17. The size can be varied as desired.

The preferred design of the patient platform 25 is to help lift the patient approximately 6 inches (15 cm) above the bed to allow the entrance of a bed pan 28 without a lot of lifting or pressure to the attendant. It is designed to cushion the patient in the downward position and the cushion memory will act like a spring and help in moving the patient six to eight inches (fifteen to twenty cm) above the bed by pulling on the lifting sheet 24 under the patient. The same design configuration is suitable for the patient platform 22.

With the patient lifted six or eight inches (fifteen to twenty cm) above the bed, the bed pan 28 can easily be placed into position or it can be removed from under the patient without any effort on the part of the patient and very little on the part of the person extracting the pan 28.

This method will improve the condition of the patient. They will be in a dry bed and they can be bathed on the patient platform 22 or 25 without having water absorbed in the bed. The water will drain into the pan under the patient.

If the patient suffers from incontinence the patient can be maintained over the bed pan 28 for long periods of time if necessary without discomfort.

The patient platform 22 or 25 can also be utilized when it is necessary to give a patient an enema. The pan 28 will be in place and the patient will not have to have discomfort when the enema is withdrawn.

The clean, simple design of patient platform 22 and 25 provides a number of advantages. To the patient, it means not having to lay in an awkward position while using a bed pan, to say nothing of avoiding a cold bed pan. Additionally, the attendant is freed of the hard lifting effort required to simultaneously lift the patient and slide the bed pan underneath. Additional patient comfort can be achieved when the patient receiving surface 23 of the patient platform 22 or 25 is covered with a thin layer of resilient closed cell cellular material. This material may be permanently attached to the platform 22 or 25 if so desired. The patient platforms 22 and 25 are light weight and under ordinary use is very long lasting and easy to store. The materials of construction employed also make the platforms 22 and 25 easy to clean and maintain. Additionally, the platform 22 or 25 has sufficient flexibility to compensate for any irregularity in the surface on which it is placed. But, above all it provides a high degree of patient comfort not previously obtainable.

The patient platform 22 or 25 can be constructed of a variety of inexpensive materials as desired. Greater portability, ease of cleaning and greater patient comfort, however, is achieved when a rigid closed cell cellular material is used for the patient carrier 15 and stiff supports 17 plus surface protector 18. These parts can be molded separately and then assembled or molded as a unit by methods well known in the molding art. Additionally, stiff support 17 and resilient support 27 can be made from separate pieces of appropriate materials and with adhesive be permanently joined together or these two parts can be molded in the same step from different materials. In any event, the rigid parts can be made from numerous polyurethane, polypropylene, polyethlene, polyvinyl chloride and the like polymeric compositions. Such materials are well known in the art. The thickness of these parts and density of the foam will vary depending upon the physical properties of the polymer and the size of patient to be supported. These parameters are readily understood by those skilled in the design and molding arts.

The resilient carrier support 27 is preferably also made of molded closed cell polymeric foam compositions. It is very desirable that these compositions be charcterized by high degree of compressibility and substantially a complete recovery to original shape upon release from compression. These foams are characterized by low densities. A typical trademark for foams of this type is Ethafoam a trademark of Dow Chemical Co.

The communicating opening 29 is shown in FIGS. 5 and 8 as having a rectangular shape. However, other shapes may be employed as desired. Additionally, a closing piece or cover may be inserted in the opening 29 when the bed pan is not in actual use. The cover may be made with the same material as the patient support member 15 is made from.

The lifting sheet may be made from such fabrics as desired. Among the more preferred sheeting materials is tight woven nylon.

Figure 9:
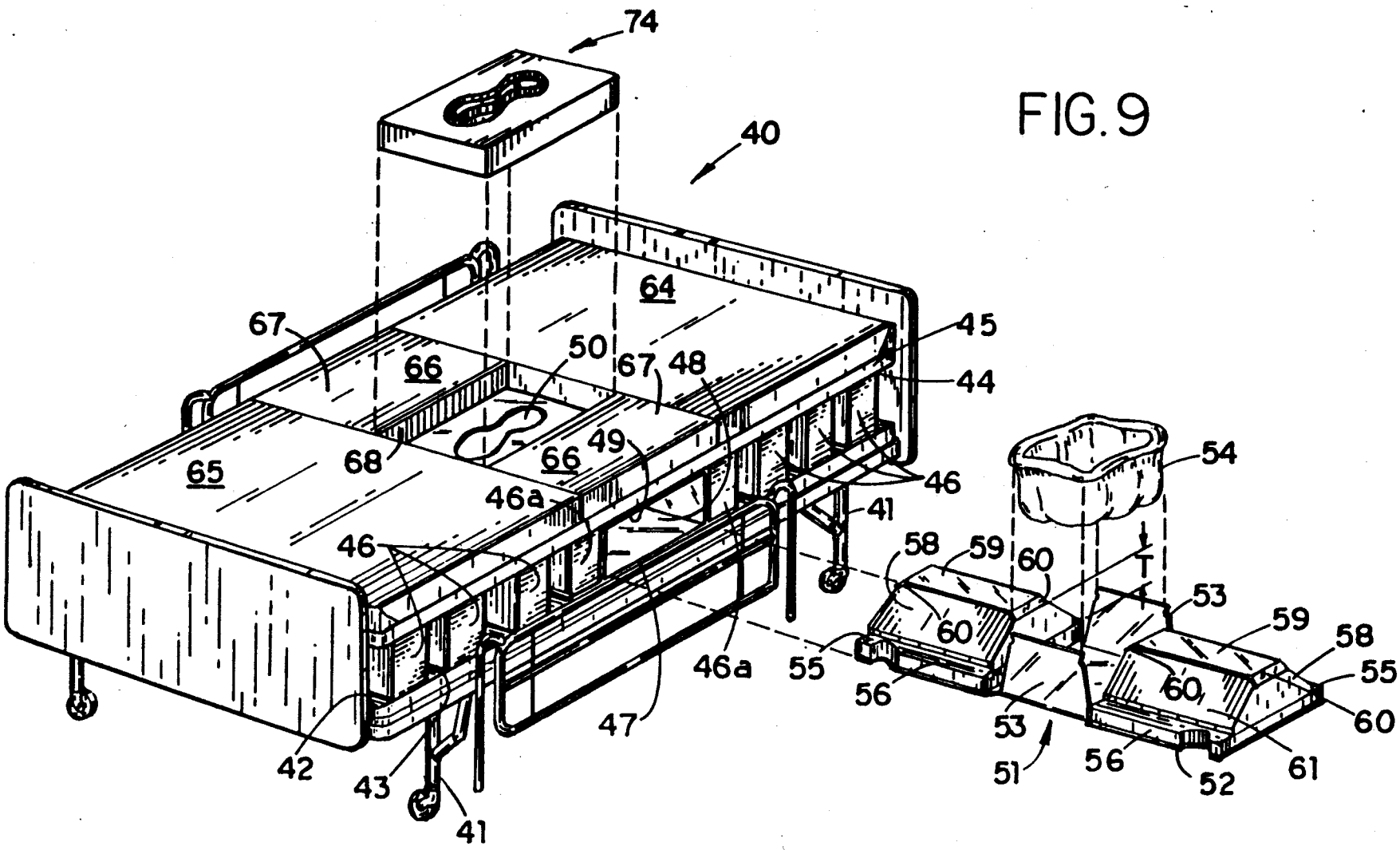
FIG. 9 is a perspective view, partially exploded, illustrating a bed made in accordance with the present invention.
Figure 10:
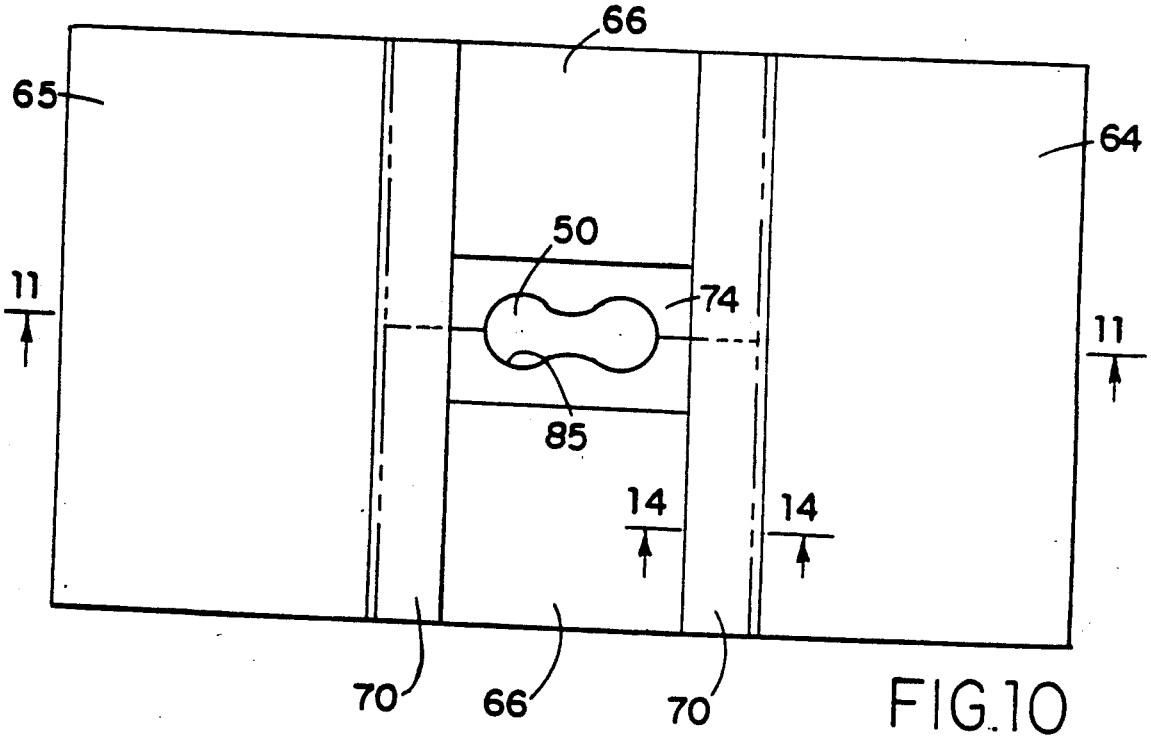
FIG. 10 is a top plan view of FIG. 9.
Figure 11:
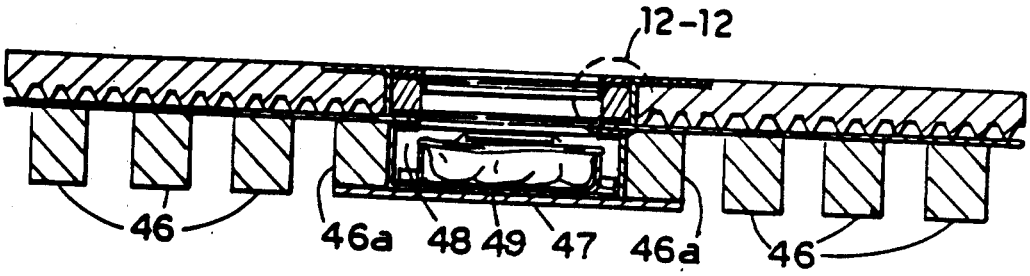
FIG. 11 is a cross sectional view of FIG. 10 taken along line 11—11.

FIGS. 9-15 illustrate a bed 40 made in accordance with the present invention. Referring in particularly to FIGS. 9 and 11, there is illustrated a perspective view and cross sectional view of bed 40 which employs a frame 41 having a substantially solid platform base 42. The frame 41 is typical of frames used in hospital beds presently on the market. Thus, the frame 41 is capable of being articulated so that the head portion can be angled upward as is typical of such prior art beds. The top surface 43 of platform base 42 supports a patient platform 44 which is similar to patient platform 22 previously discussed. Like patient platform 22, platform 42 comprises a patient carrier 45 supported by a plurality of stiff carrier supports 46. The patient carrier 45 preferably extends slightly beyond the outer supports 46. This allows the platform 42 to be used on a variety of different type and size bed frames. A pair of supports 46(*a*) are provided substantially centrally of patient carrier 45. An optional surface protector 47 is provided which connects central supports 46(*a*). The patient support carrier 45, centrally located supports 46(*a*), and surface protector 47 form a tunnel 48 which extends across the entire width of patient carrier 45. A thin liner layer 49 of a hard plastic material is placed on the inside of tunnel 48. An opening 50 is provided in patient platform 45 between central supports 46(*a*) through layer 49 thereby providing a communicating passageway into tunnel 48. The configuration of opening 50 may take any form desired, preferably an illustrated opening takes the general shape of an opening typically found in conventional bed pans.

A bed pan assemby 51 is provided for placement within tunnel 48 for receiving a patient's bodily waste through opening 50. Bed pan assembly 51 comprises a base frame 52 having a pair of support arms 53 for holding a disposable bag 54 which receives and contains the bodily waste which passes through opening 50. The support arms 53 are appropriately located so that bag 54 properly aligns with opening 50. In the particular embodiment illustrated, the frame 52 is made of a hard plastic material and in the particular embodiment illustrated, frame 52 is made of polyvinylchloride, however, it is to be understood that the frame 52 may be made of any other rigid material, preferably of a material that has a hard smooth surface to allow easy sliding against layer 49 in tunnel 48. A rigid support gripper bar 55 is located at each end of frame 52 for pulling or pushing bed assembly 50 in tunnel 48. Extending between each gripper bar 55 and each support arm 53 is a first rigid support layer 56. Rigid support layer 56 has a configuration such that a pair of recess are formed at each end to allow easy grasping of the gripper bar 55. In the particular embodiment illustrated layer 56 is made of a relatively rigid open cell plastic such as urethane. Secured to the top of the layer 56 is a cushion support layer 58. A contact strip 59 is provided on the top each cushion layer 58 and extends the length thereof. The ends 60 of contact strip 59 are angled downward so as to assist in easy placement of assembly 51 within tunnel 48. Cushion layer 58 has a thickness T such that when assembly 51 is inserted within tunnel 48, the top of contact strip 59 contacts layer 49 so as to provide a small amount of friction to hold assembly 51 in tunnel 48. The cushion layer 58 and support layer 56 act together to provide support to carrier 45 such that substantially uniform support is provided along the length of patient carrier 45. In the particular embodiment illustrated, the sides 61 of the cushion layer 58 are inclined from contact strip 59 so as to form a substantially truncated cone shaped cross sectional configuration. It is to be understood the material selection and configuration of cushion layer 58 may be selected to provide the desired support. The bed pan assembly 51 is capable of easily sliding into and out of tunnel 48 due to the smooth, hard surfaces of the frame 52 and contact strips 57 which come in contact with hard smooth surface of layer 49 of the tunnel 48.

Figure 14:
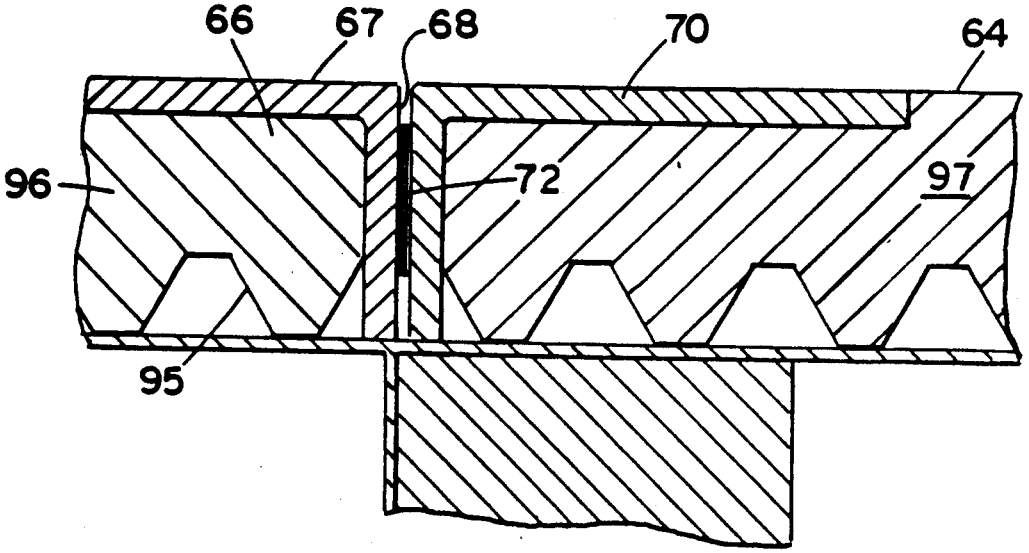
FIG. 14 is an enlarged cross sectional view of the patient platform and mattress of FIG. 10 taken along line 14—14.

Mattress means is disposed on patient platform 42 for supporting the patient. Mattress means includes a head mattress section 64, a foot mattress section 65 and a pair of hip mattress sections 66 which are disposed between the head and foot mattress section 64, 65, one on either side of opening 50 and an excretal chamber mattress section 74 disposed over opening 50. The hip mattress sections 66 each have top and side surfaces 67, 68, respectively, (see FIG. 14) made of a closed cellular material. In the particular embodiment illustrated a closed cellular material sold under the trademark ETHAFOAM, by Dow Chemical Company is used. This material has 100% memory and has a high tear resistance. This can be important, as some patients tend to pick at the material. Additionally, ETHAFOAM is anti-static and is fire retardent. However, any other suitable material may be used. This allows the outer surface to be easily cleaned as necessary. The bottom surface 95 and internal 96 section of hip section 66 are preferably made of an open cell material as illustrated in FIG. 14. Providing the bottom surface with an open cell material helps prevent the hip sections from sliding on patient platform 42. The bottom surfaces of the internal section 96 is configured to provide a plurality of substantially cone shaped projections so as to provide the desired cushion effect, however, the internal section may take any desired configuration. The head mattress section 64 and foot mattress section 65 are preferably provided each with a narrow outer band layer 70 adjacent hip sections 63 and excretal chamber mattress section 74 that is easy to clean. In the particular embodiment illustrated, band layer 70 is made of a closed cellular material similar to that of the top and side surfaces of hip mattress section 66. The remaining portions 97 of head and foot mattress 64, 65 are preferably made of an open cellular material so as to allow the mattress to breath. Allowing air beneath the patient is important with regard to minimizing bed sores on a patient. In order to minimize any movement between hip mattress sections 66 and adjacent head and foot mattress section 64, and 65, means for securing these sections together may be provided. In the particular embodiment illustrated, Velcro trademark cloth fastening tape tabs 72 are provided between these sections to minimize movement therebetween as shown in FIG. 14.

Figure 12:
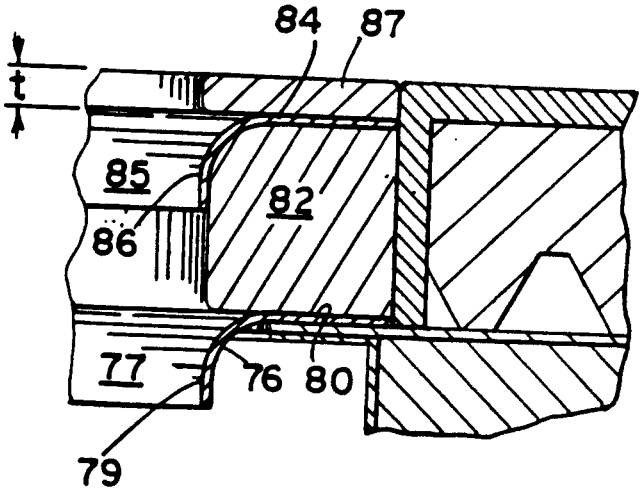
FIG. 12 is an enlarged cross sectional view of a portion of FIG. 11 taken along gash line 11.
Figure 13:
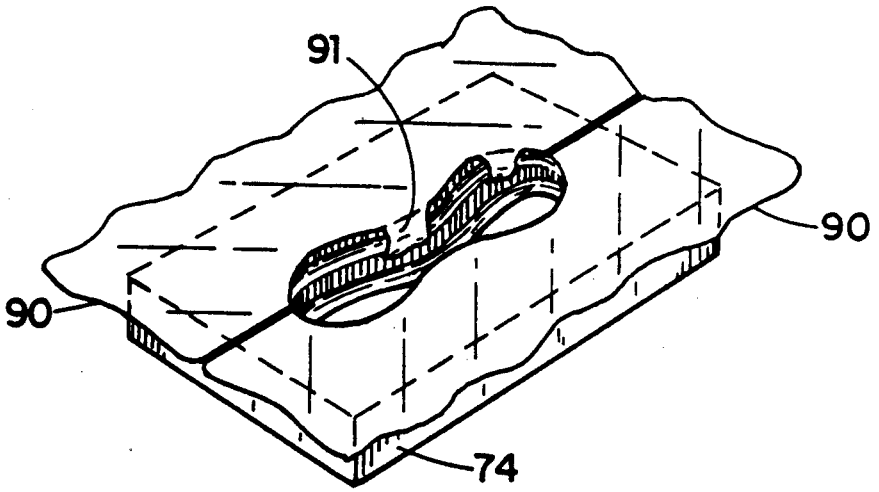
FIG. 13 is an enlarged perspective view of the excretal chamber mattress of FIG. 1.

A removable excretal chamber mattress section 74 is disposed between hip mattress section 66 and head and foot mattress sections 64, and 65 and aligns with opening 50. Referring to FIG. 12, excretal chamber mattress section 74 comprises a first semi-rigid base support plate 76 having an opening 77 with a configuration substantially identical to opening 47. Base support plate 76 includes a downwardly extending flange 79 which extends into opening 50. The semi-rigid support plate 76 provides sufficient rigidity to maintain the configuration of opening 77, yet is flexible enough to bend as required. In the particular embodiment illustrated, a base support plate 76 is made of an acrylonitrile-butadiene-styrene plastic and has a cross sectional thickness of about 0.0833" (⅛"), which is about 2.12 m.m.). Secured to the top surface 80 of base support 76 is a resilient cushion mattress section 82 which provides support in the same manner as mattress sections 64, 65, and 66. Cushion mattress section 82 is preferably made of a closed cellular material to allow easy cleaning thereof, for example, ETHAFOAM. Disposed and secured to the top of cushion section 82, there is provided a second semi-rigid support plate 84 having an opening 85 which has a configuration substantially identical to opening 77 of base support 76. A downwardly extending lip 86 is provided at opening 85. The opening 85 is slightly smaller than opening 77 of base support 76 such that lip 86, if necessary will allow telescoping within opening 77 of base support 71. This minimizes any potential interferences that may occur as a result of compression of a cushion section 82 downwardly. Applicant has found that the radius between the support plate 84 and lip 86 should be large enough so as not to cause any discomfort to the patient as he rests upon this portion of the bed. Applicant has found that a radius of approximately one inch (2.54 cm.) provides a sufficient degree of comfort to the patient. In the particular embodiment illustrated, support plate 84 is made out of a acrylonitrile-butadiene-styrene plastic. Plate 84 is sufficiently rigid so as to maintain the configuration of opening 85, yet is flexible enough to allow flexing in the vertical direction in response to the weight of the patient. This flexibility contributes significantly to the comfort of the patient in the bed. In the particular embodiment illustrated, support plate 84 has a cross sectional thickness of about 1/16" (0.0625", which is about 1.58 m.m.). On top of support plate 84 there is provided a thin cushion layer 87 of material that is capable of easily being cleaned. This cushion layer 87 serves to cushion and insulate the patient from the harder second support plate 84. In the particular embodiment illustrated, layer 87 is a closed cell plastic and has a thickness t approximately ½ inch thick. Second rigid support plate 84 provides positive support to the patient, and in addition prevents expanding of the opening such that the opening 85 will not expand open which can cause the patient to slide down into the opening, thus causing discomfort to the patient. The lip 86 can be used to receive the ends or edges of disposable linens 90 placed on adjacent mattress sections 64, 65, and 66, as illustrated in phantom line FIG. 10 and partially shown in FIG. 13. The tabs 91 of the disposable linens 90 are simply tucked between the lip 86 and cushion section 82. Disposable linens 90 are preferably used to collect or retain any waste that has unintentionally spilled thereover.

When the patient desires to use the bed pan, the patient, by himself or with the assistance of an attendant, is appropriately positioned over opening 85. The patient then simply uses the bed pan. The head portion of the mattress may be raised up for the comfort and ease of the patient. After use, any disposable linens 90 that has been used can be simply passed through opening 85 into disposable plastic bag 54. Excretal chamber mattress section 74 and surrounding area may be appropriately cleaned with water, or other appropriate cleaning solution, and allowed to flow through opening 85 into disposable bag 53. Thereafter, the attendant slides bed pan assembly 51 out and removes the soiled bag 53 and replaces it with a clean disposable bag 54 so that the bed pan may be used again. Since tunnel 48 extends across the entire width of patient carrier 45, the bed pan assembly may be inserted or removed from either side. At the same time, many appropriate linen may be placed again on the appropriate mattress sections.

Figure 15:
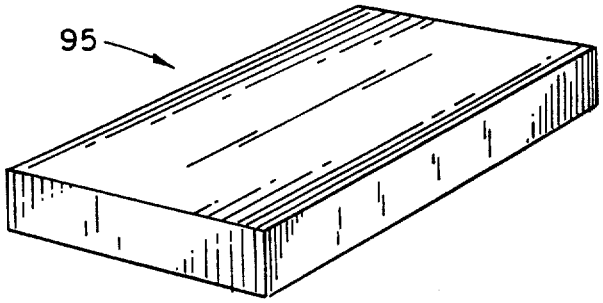
FIG. 15 is a perspective view of an optional mattress chock.

In referring to FIG. 15 there is illustrated an optional mattress chock insert 95 which may be placed into opening 50 so as to convert the bed 40 into a normal supporting mattress. Thus, the owner can easily and simply convert the bed 40 to meet the needs of the patient as required.

The foregoing examples and methods have been described in the foregoing specification for the purpose of illustration and not limitation. Many modifications and ramifications will naturally suggest themselves to those skilled in the art based on this disclosure. These are intended to be comprehended as within the scope of this invention.

I claim:

1. A bed for assisting bedridden patients in their excretory functions comprising:

(1) a frame having a substantially solid platform base;

(2) a patient platform disposed on said platform base for supporting a patient, said patient platform comprising a patient carrier support surface which is supported by a plurality of stiff carrier supports, said patient carrier support having an opening therein so as to provide a communication passage for allowing passage of excrement from said patient;

(3) mattress means disposed on top of said patient platform for supporting said patient, said mattress means includes an excretal mattress section for placement over said opening for allowing passage of excrement through said opening, wherein said excretal mattress section comprises:

(a) a first support plate having an opening therein which aligns with said opening in said patient platform, said support plate having a downward extending flange around said opening which extends into said opening of said patient platform, (b) a resilient cushion section is secured to the top of said first support plate and having an opening which corresponds to said opening of said support plate, and (c) a second support plate secured to the top of said cushion means having an opening which corresponds in configuration to said opening of said first support plate, said second support plate having a downwardly extending lip.

2. A bed according to claim 1 wherein said mattress means comprises a head section, a foot section, and a pair of hip support sections adjacent said excretal mattress section.

3. A bed according to claim 1 wherein said second support plate having a radius between said lip and said second support plate so as to minimize any discomfort to a patient.

4. A bed according to claim 1 wherein said opening of said second support plate being slightly smaller than said opening of said first support plate so as to allow telescoping of said lip downward into said opening of said first support plate.

5. A bed according to claim 4 wherein said excretal mattress section further includes a thin cushion layer secured to the top of second support plate.

6. A bed according to claim 5 wherein said hip sections have an outer covering made of a closed cellular material.

7. A bed according to claim 6 wherein said head section and foot section each have a cover layer adjacent to said excretal opening which is made of a closed cell material.

8. A bed according to claim 3 wherein patient support further includes a tunnel for receiving a bed pan assembly.

9. A bed according to claim 8 wherein bed pan assembly comprises a rigid base support for sliding within said tunnel, a pair of spaced arms for supporting a disposable container means for receiving bodily excrements, and at least one cushion support means.

10. A bed according to claim 9 wherein said tunnel is provided with a plastic liner layer of a hard smooth material so that the bed pan assembly may be easily inserted and removed therefrom.

11. A bed according to claim 10 wherein said cushion support is provided with a contact strip on top of said cushion, said contact strip having a pair of downwardly extending engagement surfaces.

12. A bed for assisting bedridden patients in their excretory functions comprising:

(1) a frame having a substantially solid platform base;

(2) a patient platform disposed on said platform base for supporting a patient, said patient platform comprising a patient carrier support surface which is supported by a plurality of stiff carrier supports, said patient carrier support having an opening therein so as to provide a communication passage for allowing passage of excrement from said patient, said platform forming a tunnel across said platform;

(3) mattress means disposed on top of said patient platform for supporting said patient, said mattress means includes an excretal mattress section for placement over said opening for allowing passage of excrement through said opening into a waste collection disposed in said tunnel, said waste collection being a bed pan assembly comprising;

(a) a support frame having means therein for engaging and supporting therefrom a disposable container;

(b) a disposable, flexible container, having means for mating with said support frame engaging means; and (c) at least one cushion support layer for providing support to said patient.

13. A bed according to claim 12 wherein a liner layer is placed in said tunnel.

14. A bed according to claim 13 wherein said bed pan assembly further comprises a contact strip portion on top of said cushion layer for contacting said liner layer.

15. A bed according to claim 12 further comprising a first rigid support layer on said support frame and under said cushion layer.

16. A bed for assisting bedridden patients in their excretory functions comprising:

(1) a frame having a substantially solid platform base;

(2) a patient platform disposed on said platform base for supporting a patient, said patient platform comprising a patient carrier support surface which is supported by a plurality of stiff carrier supports, said patient carrier support having an opening therein so as to provide a communication passage for allowing passage of excrement from said patient, said platform forming a tunnel across said platform;

(3) mattress means disposed on top of said patient platform for supporting said patient, said mattress means includes an excretal mattress section for placement over said opening for allowing passage of excrement through said opening into a waste collection disposed in said tunnel, the improvement comprising a bed pan assembly for laterally slidable insertion in and underneath the patient support surface comprising:

(a) a support frame having means therein for engaging and supporting therefrom a disposable container;

(b) a disposable flexible container having means for mating with said support frame engaging means and receiving excrement from a patient in said bed; and (c) at least one cushion support layer for providing support to said patient in said bed.

17. A bed according to claim 16 wherein said bed pan assembly further comprises a contact strip portion on top of said cushion layer.

18. A bed according to claim 16 further comprising a first rigid support layer on said support frame and under said cushion layer.

* * * * *

UNITED STATES PATENT AND TRADEMARK OFFICE

CERTIFICATE OF CORRECTION

PATENT NO. : 5,001,790

DATED : March 26, 1991

INVENTOR(S) : George C. Kuhn

It is certified that error appears in the above-identified patent and that said Letters Patent is hereby corrected as shown below:

In The Drawings

Sheet Number 1 with Fig. 5, should be deleted.

Sheet 2 of 7 - 7 of 7 should be 1 of 7 - 6 of 7, add new sheet with Fig. 15, as sheet 7 of 7.

Column 11, line 64, being claim 8 at line 1, after claim delete " 3" and insert --1--.

Signed and Sealed this

Tenth Day of November, 1992

*Attest:*

DOUGLAS B. COMER

*Attesting Officer*

*Acting Commissioner of Patents and Trademarks*